US010000861B2

(12) United States Patent
Wijenberg et al.

(10) Patent No.: US 10,000,861 B2
(45) Date of Patent: Jun. 19, 2018

(54) COATED SUBSTRATE FOR PACKAGING APPLICATIONS AND A METHOD FOR PRODUCING SAID COATED SUBSTRATE

(71) Applicant: TATA STEEL IJMUIDEN BV, Velsen-Noord (NL)

(72) Inventors: Jacques Hubert Olga Joseph Wijenberg, Amsterdam (NL); Ilja Portegies Zwart, Wormer (NL)

(73) Assignee: TATA STEEL IJMUIDEN BV, Velsen-Noord (NL)

( * ) Notice: Subject to any disclaimer, the term of this patent is extended or adjusted under 35 U.S.C. 154(b) by 916 days.

(21) Appl. No.: 14/388,201

(22) PCT Filed: Mar. 20, 2013

(86) PCT No.: PCT/EP2013/055765
§ 371 (c)(1),
(2) Date: Sep. 25, 2014

(87) PCT Pub. No.: WO2013/143928
PCT Pub. Date: Oct. 3, 2013

(65) Prior Publication Data

US 2015/0064494 A1 Mar. 5, 2015

(30) Foreign Application Priority Data

Mar. 30, 2012 (EP) ..... 12162415

(51) Int. Cl.
*C25D 5/50* (2006.01)
*C21D 1/26* (2006.01)
(Continued)

(52) U.S. Cl.
CPC ..... *C25D 5/505* (2013.01); *C21D 1/18* (2013.01); *C21D 1/26* (2013.01); *C25D 5/12* (2013.01);
(Continued)

(58) Field of Classification Search
None
See application file for complete search history.

(56) References Cited

U.S. PATENT DOCUMENTS 2,704,273 A 3/1955 Yoshida
3,042,592 A 7/1962 Schaer
(Continued)

FOREIGN PATENT DOCUMENTS

EP 0184115 A1 * 6/1986 ..... C25D 3/30
EP 0493133 A2 7/1992
(Continued)

OTHER PUBLICATIONS

International Search Report dated May 31, 2013 from International Application PCT/EP2013/055765 to Tata Steel Ijmuiden BV filed Mar. 20, 2013.
(Continued)

*Primary Examiner* — David Sample
(74) *Attorney, Agent, or Firm* — Vorys, Sater, Seymour and Pease LLP

(57) ABSTRACT

This relates to a coated substrate for packaging applications including a recrystallisation annealed single reduced steel substrate or a double reduced steel substrate subjected to recrystallisation annealing between the first and second cold rolling treatment, wherein one or both sides of the substrate is coated with an iron-tin alloy layer which contains at least 80 weight percent (wt. %) of FeSn (50 at. % iron and 50 at. % tin) and wherein the iron-tin alloy layer or layers are provided with a chromium metal-chromium oxide coating layer produced by a trivalent chromium electroplating process, and wherein the thickness of the chromium metal—chromium oxide coating layer corresponds to at least 20 mg $Cr/m^2$ and a process for producing the coated substrate.

24 Claims, 4 Drawing Sheets

(51) Int. Cl.

| | |
|---|---|
| ***C21D 1/18*** | (2006.01) |
| ***C25D 5/12*** | (2006.01) |
| ***C25D 5/48*** | (2006.01) |
| ***C25D 9/08*** | (2006.01) |
| ***C25D 5/36*** | (2006.01) |
| *C25D 3/06* | (2006.01) |

(52) U.S. Cl.

CPC ..... *C25D 5/36* (2013.01); *C25D 5/48* (2013.01); *C25D 9/08* (2013.01); *C21D 2251/02* (2013.01); *C25D 3/06* (2013.01); *Y10T 428/12549* (2015.01); *Y10T 428/12611* (2015.01)

(56) References Cited

U.S. PATENT DOCUMENTS

| | | | | |
|---|---|---|---|---|
| 3,174,917 | A | 3/1965 | Lesney et al. | |
| 3,642,586 | A | 2/1972 | Shepard et al. | |
| 3,833,483 | A | 9/1974 | Umezono et al. | |
| 3,838,024 | A * | 9/1974 | Austin et al. | C25D 5/48 205/176 |
| 3,954,574 | A | 5/1976 | Gyllenspetz et al. | |
| 4,113,580 | A * | 9/1978 | Tsutsui | C25D 3/30 205/176 |
| 4,167,460 | A | 9/1979 | Tomaszewski | |
| 4,169,022 | A | 9/1979 | Ward et al. | |
| 4,349,392 | A | 9/1982 | Huvar | |
| 4,388,158 | A | 6/1983 | Inui et al. | |
| 4,421,828 | A | 12/1983 | Alloue et al. | |
| 4,429,021 | A * | 1/1984 | Higashi | B23K 35/004 220/62.11 |
| 4,487,663 | A | 12/1984 | Nara et al. | |
| 4,520,077 | A | 5/1985 | Lavezzari | |
| 4,579,786 | A | 4/1986 | Nakakouji et al. | |
| 4,690,735 | A | 9/1987 | Laitinen et al. | |
| 4,748,095 | A | 5/1988 | Furuya et al. | |
| 4,863,060 | A | 9/1989 | Saunders | |
| 4,875,983 | A | 10/1989 | Alota et al. | |
| 4,900,406 | A | 2/1990 | Janssen et al. | |
| 5,294,326 | A | 3/1994 | Shahin | |
| 5,387,473 | A | 2/1995 | Yoshimi et al. | |
| 5,413,645 | A | 5/1995 | Saunders et al. | |
| 5,555,756 | A | 9/1996 | Fischer et al. | |
| 5,560,815 | A | 10/1996 | Sekimoto et al. | |
| 6,004,448 | A | 12/1999 | Martyak | |
| 2006/0116285 | A1 | 6/2006 | Cao et al. | |
| 2010/0108532 | A1 | 5/2010 | Pearson et al. | |
| 2012/0024714 | A1 | 2/2012 | Kwon et al. | |
| 2013/0183542 | A1 | 7/2013 | Portegies Zwart et al. | |
| 2014/0072742 | A1 | 3/2014 | Penning et al. | |
| 2015/0037604 | A1 | 2/2015 | Penning et al. | |
| 2015/0329981 | A1 | 11/2015 | Wijenberg et al. | |
| 2015/0337448 | A1 | 11/2015 | Wijenberg et al. | |
| 2016/0138178 | A1 | 5/2016 | Wijenberg et al. | |

FOREIGN PATENT DOCUMENTS

| | | | |
|---|---|---|---|
| EP | 0747510 | A1 | 12/1996 |
| FR | 2385818 | A1 | 10/1978 |
| GB | 2186887 | A | 8/1987 |
| GB | 2206131 | A | 12/1988 |
| JP | H01104480 | A | 4/1989 |
| JP | 2002285375 | A | 10/2002 |
| JP | 2005213580 | A | 8/2005 |
| WO | 0133650 | A1 | 5/2001 |
| WO | 2011020602 | A1 | 2/2011 |
| WO | 2012045791 | A1 | 4/2012 |
| WO | 2012150198 | A2 | 11/2012 |
| WO | 2013153123 | A1 | 10/2013 |
| WO | 2014079909 | A1 | 5/2014 |
| WO | 2014079910 | A1 | 5/2014 |
| WO | 2014202316 | A | 12/2014 |

OTHER PUBLICATIONS

Notification of Transmittal of the International Preliminary Report on Patentability dated May 27, 2014 from International Application PCT/EP2013/055765 to Tata Steel Ijmuiden BV filed Mar. 20, 2013.

Paramonov, V.A., et. al., "Passivation of Electrolytical Tin-plate in Trivalent Chromium Solutions", Protection of Metals, vol. 40, No. 3, Jan. 1, 2004, pp. 271-274, XP002693032, p. 271, col. 1, line 1, p. 272, col. 2, line 46.

Office Action dated Jan. 20, 2017 from U.S. Appl. No. 14/646,274 to Wijenberg et al.

Office Action dated May 16, 2017 from U.S. Appl. No. 14/646,274 to Wijenberg et al.

Office Action dated Oct. 4, 2017 from U.S. Appl. No. 14/646,274 to Wijenberg et al.

Office Action dated Dec. 15, 2017 from U.S. Appl. No. 14/646,274 to Wijenberg et al.

Office Action dated Aug. 18, 2017 from U.S. Appl. No. 14/646,238 to Wijenberg et al.

Office Action dated Jan. 30, 2018 from U.S. Appl. No. 14/646,238 to Wijenberg et al.

Office Action dated Oct. 17, 2017 from U.S. Appl. No. 14/899,241 to Wijenberg et al.

Office Action dated Feb. 23, 2018 from U.S. Appl. No. 14/899,241 to Wijenberg et al.

* cited by examiner

COATED SUBSTRATE FOR PACKAGING APPLICATIONS AND A METHOD FOR PRODUCING SAID COATED SUBSTRATE

CROSS-REFERENCE TO RELATED APPLICATIONS

This is a § 371 US National Stage Application of International Application No. PCT/EP2013/055765 filed on Mar. 20, 2013, claiming the priority of European Patent Application No. 12162415.9 filed on Mar. 30, 2012.

This invention relates to a coated substrate for packaging applications and a method for producing said coated substrate.

Tin mill products include tinplate, Electrolytic Chromium Coated Steel (ECCS, also referred to as tin free steel or TFS), and blackplate, the uncoated steel. Packaging steels are normally provided as tinplate, or as ECCS onto which an organic coating can be applied. In case of tinplate this organic coating is usually a lacquer, whereas in case of ECCS increasingly polymer coatings such as PET or PP are used, such as in the case of Protact®.

Packaging steel is provided as single or double reduced tin mill products generally in thicknesses of between 0.13 and 0.49 mm. A Single Reduced (SR) tin mill product is cold rolled directly to the finished gauge and then recrystallisation annealed. Recrystallisation is brought about by continuous annealing or batch annealing the cold rolled material. After annealing the material is usually temper rolled, typically by applying a thickness reduction of 1-2%, to improve the properties of the material. A Double Reduced (DR) tin mill product is given a first cold reduction to reach an intermediate gauge, recrystallisation annealed and then given another cold reduction to the final gauge. The resulting DR product is stiffer, harder, and stronger than SR, allowing customers to utilise lighter gauge steel in their application. These uncoated, cold rolled, recrystallisation annealed and optionally temper-rolled SR and DR packaging steels are referred to as blackplate. The first and second cold reduction may be given in the form of a cold rolling reduction in a cold-rolling tandem mill usually comprising a plurality of (usually 4 or 5) rolling stands.

Tinplate is characterised by its excellent corrosion resistance and weldability. Tinplate is supplied within a range of coating weights, normally between 1.0 and 11.2 g/m$^2$, which are usually applied by electrolytic deposition. At present, most tinplate is post-treated with hexavalent chromium, Cr(VI), containing fluids, using a dip or electrolytically assisted application process. Aim of this post-treatment is to passivate the tin surface to stop/reduce the growth of tin oxides (as too thick oxide layers can eventually lead to problems with respect to adhesion of organic coatings, like lacquers). It is important that the passivation treatment should not only suppress/eliminate tin oxide growth but should also be able to retain/improve organic coating adhesion levels. The passivated outer surface of tinplate is extremely thin (less than 1 micron thick) and consists of a mixture of tin and chromium oxides.

ECCS consists of a blackplate product which has been coated with a metal chromium layer overlaid with a film of chromium oxide, both applied by electrolytic deposition. ECCS typically excels in adhesion to organic coatings and retention of coating integrity at temperatures exceeding the melting point of tin (232° C.). This is important for producing polymer coated ECCS because during the thermoplastic coating application process the steel substrate is heated to temperatures exceeding 232° C., with the actual maximum temperature values used being dependent on the type of thermoplastic coating applied. This heat cycle is required to enable initial heat sealing/bonding of the thermoplastic to the substrate (pre-heat treatment) and is often followed by a post-heat treatment to modify the properties of the polymer. The chromium oxide layer is believed to be responsible for the excellent adhesion properties of thermoplastic coatings such as polypropylene (PP) or polyester terephthalate (PET) to ECCS. ECCS can also be supplied within a range of coating weights for both the metal and chromium oxide coating, typically ranging between 20-110 and 2-20 mg/m$^2$ respectively. ECCS can be delivered with equal coating specification for both sides of the steel strip, or with different coating weights per side, the latter being referred to as differentially coated strip. The production of ECCS currently involves the use of solutions on the basis of hexavalent chromium (Cr(VI)).

Hexavalent chromium is nowadays considered a hazardous substance that is potentially harmful to the environment and constitutes a risk in terms of worker safety. There is therefore an incentive to develop alternative metal coatings that are able to replace conventional tinplate and ECCS, without the need to resort to the use of hexavalent chromium during manufacturing and minimising, or even eliminating, the use of tin for economical reasons.

It is an object of the invention to provide an alternative for ECCS and tinplate that does not rely on the use of hexavalent chromium during manufacturing, which requires only low amounts of tin and is very suitable for coating with lacquers and thermoplastics.

It is an object of the invention to provide an alternative for ECCS that does not rely on the use of hexavalent chromium during manufacturing, which requires only low amounts of tin and provides similar coating adhesion levels to thermoplastics.

It is an object of the invention to provide an alternative for ECCS that does not rely on the use of hexavalent chromium during manufacturing, which requires only low amounts of tin and which provides good weldability.

It is an object of the invention to provide an alternative for tinplate that does not rely on the use of hexavalent chromium during manufacturing, which requires only moderate amounts of tin and that combines good corrosion resistance with improved optical properties.

It is an object of the invention to provide an alternative for tinplate that does not rely on the use of hexavalent chromium during manufacturing, which requires only moderate amounts of tin and that combines excellent corrosion resistance with optimal optical properties.

One or more of these objects is reached by a coated substrate for packaging applications comprising

- a recrystallisation annealed single reduced steel substrate or
- a double reduced steel substrate which was subjected to recrystallisation annealing between the first and second cold rolling treatment, wherein one or both sides of the substrate is coated with an iron-tin alloy layer which contains at least 80 weight percent (wt. %) of FeSn (50 at. % iron and 50 at. % tin) and wherein the iron-tin alloy layer or layers are provided with a chromium metal-chromium oxide coating layer produced by a trivalent chromium electroplating process, and wherein the thickness of the chromium metal-chromium oxide coating layer corresponds to at least 20 mg Cr/m$^2$.

The FeSn alloy layer provides corrosion protection to the underlying steel substrate. This is partly achieved by shielding the substrate, as the FeSn alloy layer is very dense and has a very low porosity. It is also a closed layer, covering the substrate completely. Moreover, the FeSn alloy itself is very corrosion resistant by nature. Potential drawback is the fact that the FeSn alloy is also electro-catalytically active with respect to hydrogen formation, which means that the FeSn coated substrate becomes sensitive to pitting corrosion. This electro-catalytic activity can be suppressed by applying an additional (metal) coating onto the bare FeSn surface, which shields the FeSn alloy surface from contact with corrosive media. A thickness of the chromium metal-chromium oxide coating layer corresponding to at least 20 mg $Cr/m^2$ is equivalent to a coating layer thickness of at least 2.8 nm using the specific density of Cr as being 7150 $kg/m^3$ (20 $mg/m^2 \equiv 2 \cdot 10^{-2}$ $g/m^2 \equiv 2 \cdot 10^{-5}$ $kg/m^2 \Rightarrow 2 \cdot 10^{-5}$ $kg/m^2/7150$ $kg/m^3 = 2.8 \cdot 10^{-9}$ m=2.8 nm). The thickness of the chromium metal-chromium oxide coating layer corresponding to at least 20 mg $Cr/m^2$ is therefore equivalent to a thickness of the chromium metal-chromium oxide coating layer of at least 2.8 nm.

It was found that a Cr—CrOx coating produced from a trivalent chromium based electroplating process provides an excellent shielding layer on a FeSn alloy coating. Not only is the electro-catalytic activity of the underlying FeSn alloy layer effectively suppressed, the Cr—CrOx coating layer also provides excellent adhesion to organic coatings. In this aspect, the chromium metal-chromium oxide (Cr—CrOx) coating produced from a trivalent chromium electrodeposition process has very similar adhesion properties compared to conventional ECCS produced via a hexavalent chromium electrodeposition process. However, it is the combination of corrosion protection offered through the FeSn alloy coating layer with the shielding and adhesion properties offered by the Cr—CrOx coating layer that creates a coated product with excellent overall product performance characteristics. The material according to the invention can be used to directly replace ECCS for the same applications, as they have similar product features (excellent adhesion to organics, retention of coating integrity at temperatures exceeding the melting point of tin).

In addition, the material according to the invention was found to be weldable, where ECCS is not weldable. It can be used in combination with thermoplastic coatings, but also for applications where traditionally ECCS is used in combination with lacquers (i.e. for bakeware, or products with moderate corrosion resistance requirements) or as a substitute for conventional tinplate for applications where welding is involved and where requirements in terms of corrosion resistance are moderate.

The big advantage, both in terms of environmental impact and health and safety is the fact that with this invention the use of hexavalent chromium chemistry is prevented, while it is possible to retain the product performance properties normally attributed to ECCS and tinplate.

In a preferred embodiment the iron-tin alloy layer contains at least 85 wt. % of FeSn, preferably at least 90 wt. %, more preferably at least 95 wt. %. The higher the fraction of FeSn, the better the corrosion protection of the substrate. Although ideally the iron-tin alloy layer consists of FeSn only, it appears to be difficult to prevent the presence of very small fractions of other compounds such as α-Sn, β-Sn, $Fe_3Sn$ or oxides. However, these small fractions of other compounds have been found to have no impact on the product performance in any way.

In an embodiment of the invention the substrate for packaging applications which is coated with an iron-tin alloy layer comprising the said amounts of FeSn (50 at. % iron and 50 at. % tin) is provided with a tin layer prior to application of the chromium metal-chromium oxide coating layer, optionally wherein the tin layer was subsequently reflowed prior to application of the chromium metal-chromium oxide coating layer. The tin layer is a closed layer, covering the substrate completely. So in these embodiments an additional tin layer, reflowed or not, is provided between the iron-tin alloy layer and the chromium metal-chromium oxide coating layer. The benefits of adding an additional tin layer are the possibility of changing the optical properties of the product and to improve the corrosion resistance of the material. By adding an additional layer consisting of unalloyed tin metal a substrate with a much lighter colour is obtained (i.e. higher L-value), which can be important for decorative purposes. Moreover, the presence of a thin layer (e.g. typically 0.3-0.6 g $Sn/m^2$) of unalloyed tin metal improves the corrosion resistance of the material. By flowmelting this product also the gloss of the coated material can be increased, by reducing the surface roughness of the coated substrate, while this also contributes by even further improving the corrosion resistance through the reduction of porosity of the additional tin layer and the formation of an additional iron-tin alloy, $FeSn_2$, in between the FeSn and unalloyed tin metal layers.

The Cr—CrOx coating prevents the oxidation of tin metal to tin oxide by passivation of the top layer. This passivation effect was observed to take place at Cr—CrOx coating thicknesses of ≥20 mg $Cr/m^2$. The Cr—CrOx coating also prevents sulphur staining of tin metal through a shielding effect. To prevent sulphur staining the Cr—CrOx coating thickness was found to have to be ≥60 mg $Cr/m^2$.

Again the big advantage, both in terms of environmental impact and health and safety is the fact that with this invention the use of hexavalent chromium chemistry is prevented, while it is possible to retain the product performance properties normally attributed to tinplate These embodiments aim to replace conventional tinplate. The major advantage, beside the elimination of hexavalent chromium from production is that a similar corrosion resistance performance is obtained as compared to conventional tinplate but at a much lower tin coating thickness. The material replaces the conventional 2.8 g $Sn/m^2$ by 0.6 g $Sn/m^2$, which is a reduction in use of tin of nearly 80%.

The variant with an additional layer of non-reflowed, unalloyed tin metal also aims to replace conventional tinplate. In addition to providing a material with a lighter colour, the corrosion resistance of this material is improved, increasing its suitability for it to be used to make containers for more aggressive filling media.

The variant with a reflowed tin layer again aims to replace conventional tinplate. It is very similar to the variant without reflowing, but the reflowing will lead to a product with higher gloss. Also, the reflow operation is believed to further improve the corrosion resistance compared to the non-reflowed variant. However, this improvement comes at the expense of an additional process step (melting the tin layer and cooling it) so that this step is not used if it is not necessary from the properties point of view.

In an embodiment of the invention the initial tin coating weight, prior to annealing to form the iron-tin alloy layer is at most 1000 $mg/m^2$, preferably between 100 and 600 $mg/m^2$ of substrate, and/or wherein the chromium metal-chromium oxide layer contains a total chromium content of at least 20 mg $Cr/m^2$, preferably of at least 40 mg $Cr/m^2$ and more preferably of at least 60 mg $Cr/m^2$ and/or preferably at most 140 mg $Cr/m^2$, more preferably at most 90 mg $Cr/m^2$, most preferably at most 80 mg $Cr/m^2$.

The inventors found that starting at a thickness of the Cr—CrOx conversion coating of ~20 mg $Cr/m^2$ already results in a significant improvement in comparison to the samples without a Cr—CrOx conversion coating and that starting at a thickness of about 60 mg Cr/m$^2$ the performance is already identical to that of currently marketed products which are produced using Cr(VI)-based solutions.

The Cr—CrOx coating according to the invention provides excellent adhesion to organic coatings such as lacquers and thermoplastic coating layers.

In an embodiment the coated substrate is further provided with an organic coating, consisting of either a thermoset organic coating, or a thermoplastic single layer coating, or a thermoplastic multi-layer polymer coating. The Cr—CrOx layer provides excellent adhesion to the organic coating similar to that achieved by using conventional ECCS.

In the case where the iron-tin layer is provided with an additional tin layer after the diffusion annealing it should be noted that the presence of unalloyed tin metal means that this layer can start melting at T≥232° C. (i.e. the melting point of tin), making this embodiment unsuitable for lamination with polymers that require the use of temperatures during processing above 232° C., such as PET.

In a preferred embodiment the thermoplastic polymer coating is a polymer coating system comprising one or more layers comprising the use of thermoplastic resins such as polyesters or polyolefins, but can also include acrylic resins, polyamides, polyvinyl chloride, fluorocarbon resins, polycarbonates, styrene type resins, ABS resins, chlorinated polyethers, ionomers, urethane resins and functionalised polymers. For clarification:

- Polyester is a polymer composed of dicarboxylic acid and glycol. Examples of suitable dicarboxylic acids include therephthalic acid, isophthalic acid, naphthalene dicarboxylic acid and cyclohexane dicarboxylic acid. Examples of suitable glycols include ethylene glycol, propane diol, butane diol, hexane diol, cyclohexane diol, cyclohexane dimethanol, neopentyl glycol etc. More than two kinds of dicarboxylic acid or glycol may be used together.
- Polyolefins include for example polymers or copolymers of ethylene, propylene, 1-butene, 1-pentene, 1-hexene or 1-octene.
- Acrylic resins include for example polymers or copolymers of acrylic acid, methacrylic acid, acrylic acid ester, methacrylic acid ester or acrylamide.
- Polyamide resins include for example so-called Nylon 6, Nylon 66, Nylon 46, Nylon 610 and Nylon 11.
- Polyvinyl chloride includes homopolymers and copolymers, for example with ethylene or vinyl acetate.
- Fluorocarbon resins include for example tetrafluorinated polyethylene, trifluorinated monochlorinated polyethylene, hexafluorinated ethylene-propylene resin, polyvinyl fluoride and polyvinylidene fluoride.
- Functionalised polymers for instance by maleic anhydride grafting, include for example modified polyethylenes, modified polypropylenes, modified ethylene acrylate copolymers and modified ethylene vinyl acetates.

Mixtures of two or more resins can be used. Further, the resin may be mixed with anti-oxidant, heat stabiliser, UV absorbent, plasticiser, pigment, nucleating agent, antistatic agent, release agent, anti-blocking agent, etc. The use of such thermoplastic polymer coating systems have shown to provide excellent performance in can-making and use of the can, such as shelf-life.

According to a second aspect the invention is embodied in a process for producing a coated steel substrate for packaging applications, the process comprising the steps of providing a recrystallisation annealed single reduced steel substrate, or a double reduced steel substrate, which was subjected to recrystallisation annealing between the first and second cold rolling treatment; providing a first tin layer onto one or both sides of the steel substrate in a first electroplating step, preferably wherein the tin coating weight is at most 1000 mg/m$^2$, preferably between at least 100 and/or at most 600 mg/m$^2$ of substrate surface; diffusion annealing the blackplate substrate provided with said tin layer in a reducing gas atmosphere to an annealing temperature $T_a$ of at least 513° C. for a time $t_a$ sufficient to convert the first tin layer into an iron-tin alloy layer or layers to obtain an iron-tin alloy layer or layers which contains or contain at least 80 weight percent (wt. %) of FeSn (50 at. % iron and 50 at. % tin); rapidly cooling the substrate with the iron-tin alloy layer(s) in an inert, non-oxidising cooling medium, while keeping the coated substrate in a reducing or inert gas atmosphere prior to cooling, so as to obtain a robust, stable surface oxide; depositing a chromium metal-chromium oxide coating on the substrate with the iron-tin alloy layer(s) comprising electrolytically depositing on said substrate said chromium metal-chromium oxide coating in one plating step from a plating solution comprising a mixture of a trivalent chromium compound, a chelating agent, an optional conductivity enhancing salt, an optional depolarizer, an optional surfactant and to which an acid or base can be added to adjust the pH.

The inventors found that is necessary to diffusion anneal a tin coated blackplate substrate at a temperature ($T_a$) of at least 513° C. to obtain the coating layer according to the invention. The diffusion annealing time ($t_a$) at the diffusion annealing temperature $T_a$ is chosen such that the conversion of the tin layer into the iron-tin layer is obtained. The predominant and preferably sole iron-tin alloy component in the iron-tin layer is FeSn (i.e. 50 atomic percent (at. %) iron and 50 at. % tin). It should be noted that the combination of diffusion annealing time and temperature are interchangeable to a certain extent. A high $T_a$ and a short $t_a$ will result in the formation of the same iron-tin alloy layer than a lower $T_a$ and a longer $t_a$. The minimum $T_a$ of 513° C. is required, because at lower temperatures the desired (50:50) FeSn layer does not form. Also the diffusion annealing does not have to proceed at a constant temperature, but the temperature profile can also be such that a peak temperature is reached. It is important that the minimum temperature of 513° C. is maintained for a sufficiently long time to achieve the desired amount of FeSn in the iron-tin diffusion layer. So the diffusion annealing may take place at a constant temperature $T_a$ for a certain period of time, or the diffusion annealing may, e.g., involve a peak metal temperature of $T_a$. In this latter case the diffusion annealing temperature is not constant. It was found to be preferable to use a diffusion annealing temperature $T_a$ of between 513 and 645° C., preferably of between 513 and 625° C. A lower $T_a$ limits the risk of affecting the bulk mechanical properties of the substrate during the diffusion annealing.

In an embodiment of the invention a process is provided wherein the annealing is performed in a reducing gas atmosphere, such as HNX, while keeping the coated substrate in a reducing or inert gas atmosphere prior to cooling using non-oxidising or mildly oxidising cooling medium, so as to obtain a robust, stable surface oxide.

In an embodiment of the invention the fast cooling after diffusion annealing is achieved by means of quenching with water, wherein the water used for quenching has a temperature between room temperature and its boiling temperature. It is important to maintain a homogeneous cooling rate over the strip width during cooling to eliminate the risks of the strip getting deformed due to cooling buckling. This can be achieved by applying cooling water through a (submerged) spray system that aims to create an even cooling pattern on the strip surface. To ensure a homogeneous cooling rate during spraying it is preferred to use cooling water with a temperature between room temperature and 60° C. to prevent that the water reaches boiling temperatures upon contact with the hot steel strip. The latter can result in the onset of localized (unstable) film boiling effects that can lead to uneven cooling rates over the surface of the steel strip, potentially leading to the formation of cooling buckles In an embodiment of the invention the annealing process comprises i) the use of a heating unit able to generate a heating rate preferably exceeding 300° C./s, like an inductive heating unit, in a hydrogen containing atmosphere such as HNX, and/or ii) followed by a heat soak which is kept at the annealing temperature to homogenise the temperature distribution across the width of the strip, and/or iii) the annealing process is directly followed by rapid cooling at a cooling rate of at least 100° C./s, and/or iv) wherein the cooling is preferably performed in an reducing gas atmosphere such as a HNX atmosphere, and/or v) the cooling is preferably performed by means of water quenching, by using (submerged) spraying nozzles, wherein the water used for quenching has a minimal dissolved oxygen content and has a temperature between room temperature and 80° C., preferably between room temperature and 60° C., while keeping the substrate with the iron-tin alloy layer(s) shielded from oxygen by maintaining an inert or reducing gas atmosphere, such as HNX gas, prior to quenching.

In addition to allowing the surface alloying process by diffusion annealing to take place, this heat treatment also affects the mechanical properties of the bulk steel substrate, which is the result of a combination of material ageing and recovery effects. These recovery effects can be used by adapting the diffusion annealing temperature-time profile so that recovery of the deformed substrate takes place. The diffusion annealing is then a simultaneous diffusion and recovery annealing. The impact on the mechanical properties of the bulk steel substrate varies with steel composition, e.g. carbon content of the steel, and mechanical processing history of the material, e.g. amount of cold rolling reduction, batch or continuous annealing. In case of low carbon steels (which ranges to up to about 0.15 wt. % C, but for packaging purposes is normally up to about 0.05 wt. %) or extra low carbon steels (typically up to about 0.02 wt. % C) the yield and ultimate strength can be affected, as a result of carbon going into solution. Also, a varying amount of yield point elongation is observed after this heat treatment, for CA and BA carbon steel grades. This yield point elongation effect can be suppressed by temper rolling. Interestingly, the formability of DR steel grades can be significantly enhanced as a result of the heat treatment. This effect is attributed to recovery of the deformed steel, which is normally not annealed after the second cold rolling operation, and which leads to improved elongation values. This recovery effect becomes more pronounced with increasing reduction applied in the second cold-rolling operation.

In an embodiment of the invention the substrate consists of an interstitial-free low, extra-low or ultra-low carbon steel, such as a titanium stabilised, niobium stabilised or titanium-niobium stabilised interstitial-free steel. By using low, extra-low or ultra-low carbon, interstitial free (IF) steels, like titanium, niobium or titanium-niobium stabilised low, extra-low or ultra-low carbon steel, the beneficial aspects of the annealing process on mechanical properties, including the recovery effect for DR substrates, of the bulk steel substrate can be retained without the potential drawbacks of carbon or nitrogen ageing. This is attributed to the fact that in case of IF steels all interstitial carbon and nitrogen present in the bulk steel are chemically bonded, preventing them from going into solution during annealing. During diffusion annealing experiments no ageing effects of IF steels were observed. This can be advantageous with the aim of producing a substrate that is absolutely free of yield point elongation effects, also after prolonged storage, to be able to guarantee the production of containers and/or parts of metal packing that need to be absolutely free of so-called Lüders lines.

The substrate is not subjected to further extensive reductions in thickness after forming of the FeSn-layer. A further reduction in thickness may cause the FeSn-layer to develop cracks. The reductions as a result of temper rolling or stretcher-levelling (if required) and the reductions subjected to the material during the production of the packaging applications do not cause these cracks to form, or if they form, to adversely affect the performance of the coated substrate. Temper rolling reductions are normally between 0 and 3%.

After the substrate is provided with the FeSn alloy coating layer, the surface can be optionally activated by dipping the material in a sulphuric acid solution, typically a few seconds in a solution containing 50 g/l of sulphuric acid, and followed by rinsing with water prior to application of the Cr—CrOx coating.

In an embodiment the electro-deposition of the Cr—CrOx coating is achieved by using an electrolyte in which the chelating agent comprises a formic acid anion, the conductivity enhancing salt contains an alkali metal cation and the depolarizer comprises a bromide containing salt.

In an embodiment the cationic species in the chelating agent, the conductivity enhancing salt and the depolarizer is potassium. The benefit of using potassium is that its presence in the electrolyte greatly enhances the electrical conductivity of the solution, more than any other alkali metal cation, thus delivering a maximum contribution to lowering of the cell voltage required to drive the electrodeposition process.

In an embodiment of the invention the composition of the electrolyte used for the Cr—CrOx deposition was: 120 g/l basic chromium sulphate, 250 g/l potassium chloride, 15 g/l potassium bromide and 51 g/l potassium formate. The pH was adjusted to values between 2.3 and 2.8 measured at 25° C. by the addition of sulphuric acid.

Surprisingly, it was found that it is possible to electro-deposit a chromium metal-chromium oxide coating layer from this electrolyte in a single process step. From prior art, it follows that addition of a buffering agent to the electrolyte, like e.g. boric acid, is strictly required to enable the electro-deposition of chromium metal to take place. In addition, it has been reported that it is not possible to deposit chromium metal and chromium oxide from the same electrolyte, due to this buffering effect (with a buffering agent being required for the electro-deposition of the chromium metal but excludes the formation of chromium oxides and vice versa). However, it was found that no such addition of a buffering agent was required to deposit chromium metal, provided that a sufficiently high cathodic current density is being applied. It should be noted that most of the electrical current supplied to the substrate (cathode) is used for the generation of hydrogen gas, while only a small part of the electrical current is used for the electro-deposition of chromium species.

It is believed that a certain threshold value for the current density must be exceeded for the electro-deposition of chromium metal to occur, which is closely linked to pH at the strip surface reaching certain values as a result of the evolution of hydrogen gas and the equilibration of various (chelated) poly chromium hydroxide complexes. It was found that after crossing this threshold value for the current density that the electro-deposition of the chromium metal-chromium oxide coating layer increases virtually linearly with increasing current density, as observed with conventional electro-deposition of metals, following Faraday's law. The actual value for the threshold current density seems to be closely linked to the mass transfer conditions at the strip surface: it was observed that this threshold value increases with increasing mass transfer rates. This phenomenon can be explained by changes in pH values at the strip surface: at increasing mass transfer rates the supply of hydronium ions to the strip surface is increased, necessitating an increase in cathodic current density to maintain a specific pH level (obviously higher than the bulk pH) at the strip surface under steady-state process conditions. The validity of this hypothesis is supported by results obtained from experiments in which the pH of the bulk electrolyte was varied between a value of 2.5 and 2.8: the threshold value for the current density decreases with increasing pH value.

Concerning the electro-deposition process of Cr—CrOx coatings from trivalent chromium based electrolytes, it is important to prevent/minimise the oxidation of trivalent chromium to its hexavalent state at the anode. Suitable anode materials consist of graphite, platinised titanium, titanium provided with iridium oxide, and titanium provided with a mixed metal oxide coating containing iridium oxide and tantalum oxide.

In an embodiment the iron-tin diffusion layer is provided with a tin metal layer prior to application of the chromium metal-chromium oxide coating, optionally wherein the tin layer is subsequently reflowed prior to application of the chromium metal-chromium oxide coating. Prior to electro-deposition of the tin metal layer onto the FeSn alloy coating, the FeSn surface is optionally activated by dipping the material into a sulphuric acid solution, typically a few seconds in a solution containing 50 g/l of sulphuric acid, and followed by rinsing with water. Prior to the subsequent electro-deposition of the Cr—CrOx coating on the (reflowed) tin metal coating, the tin surface is optionally pre-treated by dipping the material into a sodium carbonate solution and applying a cathodic current at a current density of 0.8 $A/dm^2$ for a short period of time, typically 1 second. This pre-treatment is used to remove the oxides from the tin-surface before applying the Cr—CrOx coating.

In an embodiment the coated substrate is further provided on one or both sides with an organic coating, consisting of a thermosetting organic coating by a lacquering step, or a thermoplastic single layer, or a thermoplastic multi-layer polymer by a film lamination step or a direct extrusion step.

In an embodiment the thermoplastic polymer coating is a polymer coating system comprising one or more layers comprising the use of thermoplastic resins such as polyesters or polyolefins, but can also include acrylic resins, polyamides, polyvinyl chloride, fluorocarbon resins, polycarbonates, styrene type resins, ABS resins, chlorinated polyethers, ionomers, urethane resins and functionalised polymers; and/or copolymers thereof; and/or blends thereof.

As mentioned previously, the heat treatment applied to achieve diffusion annealing can negatively impact the bulk mechanical properties of the steel substrate, due to ageing effects. It is possible to improve the bulk mechanical properties of the steel substrate after said heat treatment by stretching the material to a small extent (i.e. between 0-3%, preferably at least 0.2%, more preferably at least 0.5%) through e.g. temper rolling or passing the material through a stretcher-leveller. Such a treatment not only serves to improve the bulk mechanical properties (e.g. eliminate/reduce yield point elongation, improve the Rm/Rp ratio, etc.), but can also be used to improve the strip shape (e.g. to reduce the level of bow). Furthermore, like with conventional temper rolling, such a material conditioning process can also potentially be used to modify the surface structure.

The application of the stretching treatment is envisaged to be possibly applied at various stages within the manufacturing process:

- directly after the diffusion annealing step, prior to application of any further coating layers.
- after application of a (reflowed) tin metal layer onto the FeSn surface. This offers the additional option of modifying the structure of the tin metal layer to e.g. improve the porosity of this layer (i.e. lower the porosity) and/or to change the surface roughness to improve the optical properties (i.e. to improve gloss levels).
- after the material is fully coated.

Regarding the latter option, it can be done after application of a thermoplastic coating on the Cr—CrOx coating. Important benefit of this particular sequence is that the ageing effects of both diffusion annealing and application of the thermoplastic film are counteracted, creating a fully coated material with ideal mechanical properties positively contributing to its successful use in various canmaking operations.

In an embodiment of the invention the annealing of the tin-coated steel substrate is performed at a temperature $T_a$ of at least 513° C. for an annealing time $t_o$ as described hereinabove not only to convert the tin layer into an iron-tin alloy layer which contains at least 80 weight percent (wt. %) of FeSn (50 at. % iron and 50 at. % tin), but to also and simultaneously obtain a recovered microstructure wherein no recrystallisation of the single reduced substrate or double reduced substrate takes place (i.e. recovery annealing). The term 'recovered microstructure' is understood to mean a heat treated cold rolled microstructure which shows minimal or no recrystallisation, with such eventual recrystallisation being confined to localised areas such as at the edges of the strip. Preferably the microstructure is completely unrecrystallised. The microstructure of the packaging steel is therefore substantially or completely unrecrystallised. This recovered microstructure provides the steel with a significantly increased deformation capability at the expense of a limited decrease in strength.

EXAMPLES

The invention is now further explained by means of the following, non-limiting examples and figures.

Packaging steel sheet samples (consisting of a commonly used low carbon steel grade and temper) were cleaned in a commercial alkaline cleaner (Chela Clean KC-25 supplied by Foster Chemicals), rinsed in de-ionised water, pickled in a 50 g/l sulphuric acid solution at room temperature for 5 s, and rinsed again. Then, the samples were plated with a tin coating of 600 mg/m$^2$ from an MSA (Methane Sulfonic Add) bath that is commonly used for the production of tinplate in a continuous strip plating line. A current density of 10 A/dm$^2$ was applied for 1 s.

After said tin plating, the samples were annealed in a reducing gas atmosphere, using HNX containing 5% $H_2$(g). The samples were heated from room temperature to 600° C. with a heating rate of 100° C./s. Immediately after the sample had reached its peak temperature of 600° C., one sample was cooled down by means of intense blowing with helium gas and another sample was cooled down by means of a water quench ($T_a$=600° C., $t_a$=1 s). In case of cooling with helium gas, the cooling rate was 100° C./s. Cooling by means of a water quench goes much faster. In about 1 second the sample is cooled down from 600° C. to 80° C., being the temperature of the water in the quench tank, i.e. the cooling rate is about 500° C./s.

Figure 1:
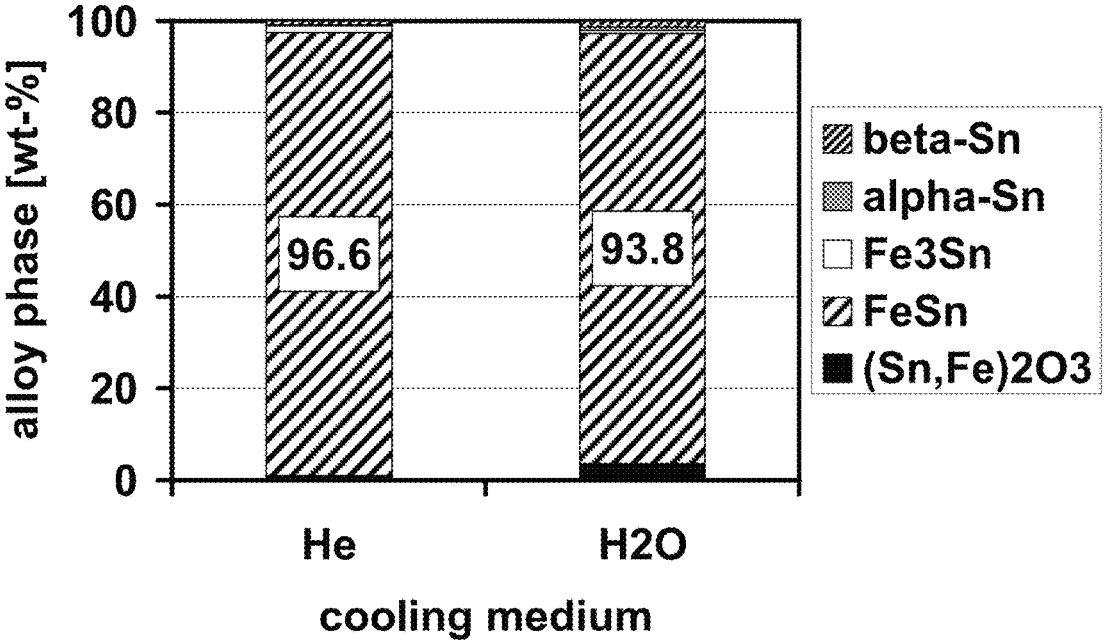
FIG. 1 shows the phases, which are formed during an annealing step, that were analyzed by X-Ray Diffraction.

The phases, which are formed during this annealing step, were analysed by means of X-Ray Diffraction (FIG. 1). In both cases, an iron-tin alloy layer is formed which contains more than 90% of the desired FeSn alloy phase (96.6 and 93.8 respectively). Other examples showed values of 85.0 to 97.8% FeSn for annealing temperatures from 550 to 625° C., wherein annealing at annealing temperatures of above 550 and below 615° C. resulted in a range between 92.2% to 97.8%.

Figure 2:
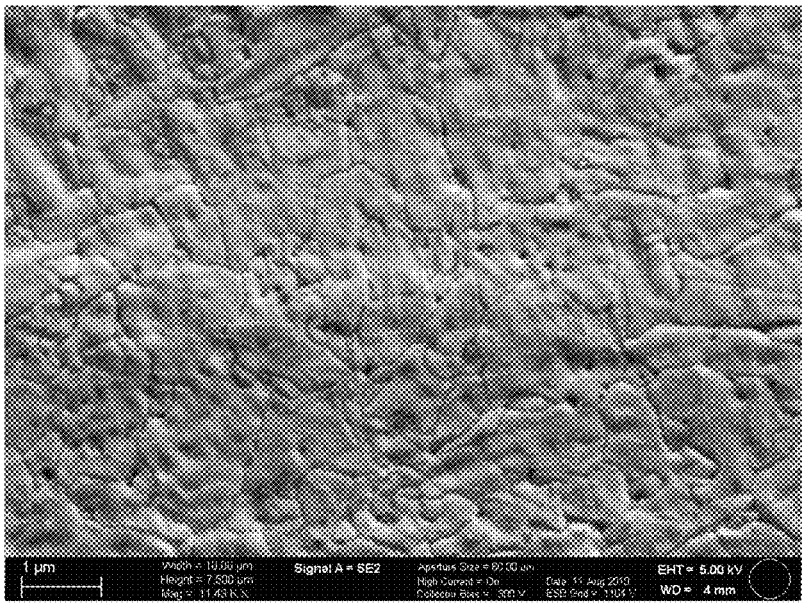
FIG. 2 shows the morphology of a coating that was analyzed with Scanning Electron Microscopy as a SE (Secondary Electron) image of a sample cooled with helium gas.
Figure 3:
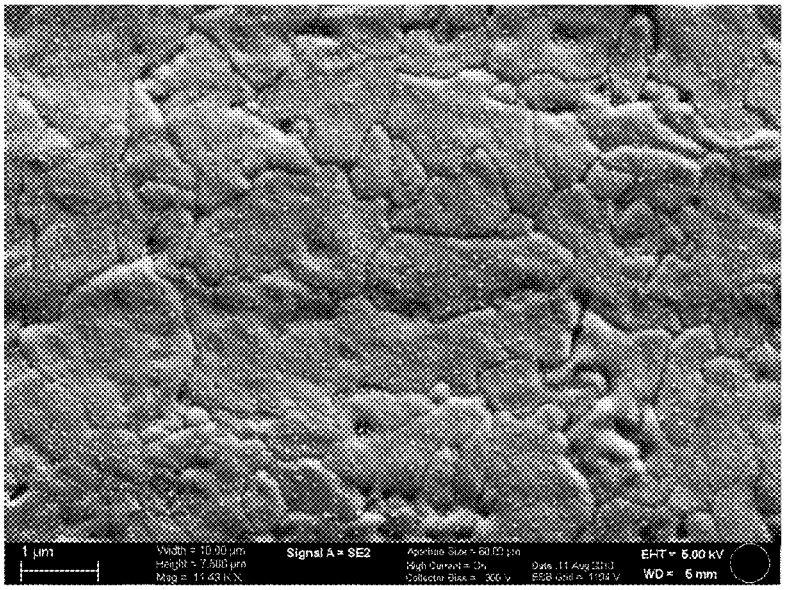
FIG. 3 shows the morphology of a coating that was analyzed with Scanning Electron Microscopy as a SE (Secondary Electron) image of a sample cooled with water.

The morphology of the coating was analysed with Scanning Electron Microscopy. SE (Secondary Electron) images of both samples described above are given in FIGS. 2 and 3 which show the SEM SE image of the sample cooled with helium gas (FIG. 2) and with water (FIG. 3). In both cases, a very dense and compact structure is formed, which is typical for the FeSn alloy phase. The distance bar indicates a length of 1 μm Steel sheet samples with an FeSn coating thus produced were transformed into cylinders with a diameter of 73 mm by roll forming and welding. These cylinders serve as the electrodes in an electrochemical cell that was used for investigating the electro-deposition of a chromium metal-chromium oxide (Cr—CrOx) coating layer from a trivalent chromium electrolyte.

The mass transfer rate (flux) in this electrochemical cell is well defined and is controlled by rotating the cylinder electrode at a certain rotation speed. A rotation speed of 776 rotations per minute (RPM) was used for the Cr—CrOx electro-deposition. Under these conditions the mass transfer rate at the cylinder electrode corresponds to the mass transfer rate in a strip plating line that is running at a line speed of about 100 m/min.

The composition of the electrolyte used for the Cr—CrOx deposition was: 120 g/l basic chromium sulphate, 250 g/l potassium chloride, 15 g/l potassium bromide and 51 g/l potassium formate. The pH was adjusted to 2.3 measured at 25° C. by the addition of sulphuric acid.

Cr—CrOx coating was deposited at various current densities (see Table). The electrolysis (deposition) time was 1 s and the temperature of the electrolyte was 50° C.

TABLE 1

| deposition results | | | | | |
|---|---|---|---|---|---|
| current [A] | current density [A/dm$^2$] | rotation speed [RPM] | deposition time [s] | Cr-(XRF) [mg/m$^2$] | Cr-(XPS) [mg/m$^2$] |
| 70.0 | 26.9 | 776 | 1.0 | 42.6 | 43.8 |
| 75.0 | 28.9 | 776 | 1.0 | 68.0 | 76.3 |
| 80.0 | 30.8 | 776 | 1.0 | 99.7 | 95.4 |
| 85.0 | 32.7 | 776 | 1.0 | 134.4 | 157.1 |
| 90.0 | 34.6 | 776 | 1.0 | 171.8 | 186.2 |

All samples show a shiny metal appearance. A SEM image of the sample of the Cr—CrOx layer deposited at a current density of 28.9 A/dm$^2$ shows that the Cr-grains are small, closed packed and have a homogeneous size distribution.

The amount of total chromium deposited was determined by means of XRF (X-Ray Fluorescence) analysis. The reported XRF values are corrected for the contribution of the substrate.

X-ray Photoelectron Spectroscopy (XPS) spectra and depth profiles were recorded on a Kratos XSAM-800 using Al—Kα X-rays of 1486.6 eV. The sputter rate was calibrated using a BCR-standard of 30 nm $Ta_2O_5$ on Ta and was 0.57 nm/min. The sputter rate for Cr-species is similar to $Ta_2O_5$. The amount of total chromium deposited can also be obtained from the XPS measurements by integrating the contributions from all Cr-species.

Besides XPS also Transmission Electron Microscopy (TEM) and Energy Dispersive X-ray analysis (EDX) was used to characterise the Cr—CrOx coating. The TEM-specimens were prepared by means of Focused Ion Beam (FIB).

Figure 4:
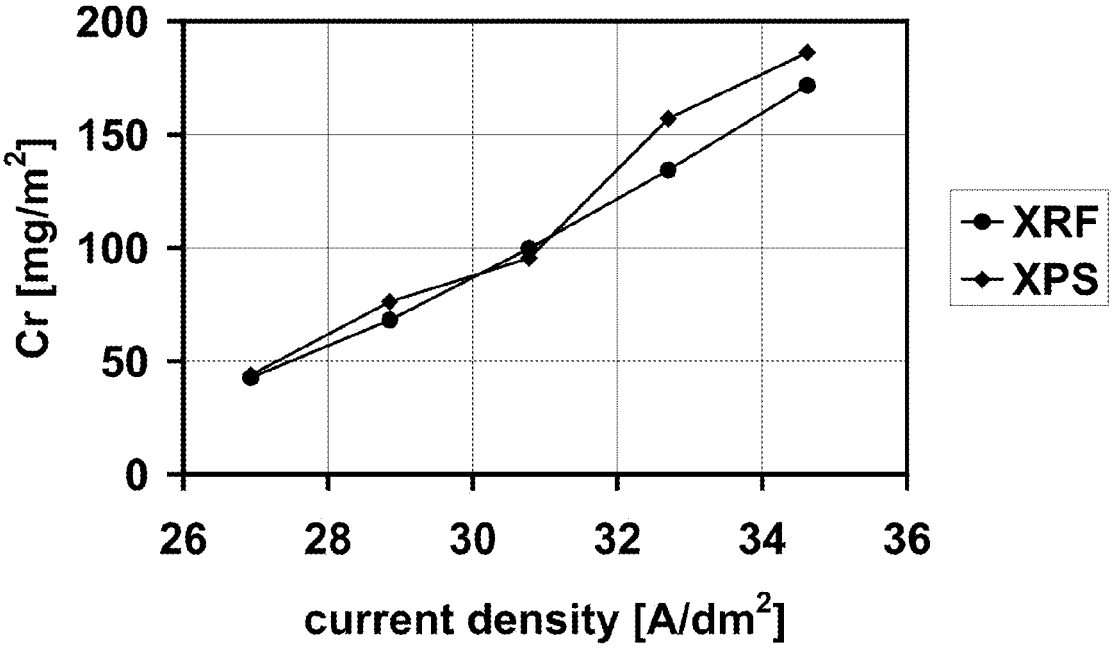
FIG. 4 shows an amount of total chromium measured by XPS and XRF plotted versus current density.

The amount of total chromium measured by XPS and XRF are plotted versus the current density in FIG. 4. The results from the XPS measurements match very well with the results from the XRF measurements.

Figure 5:
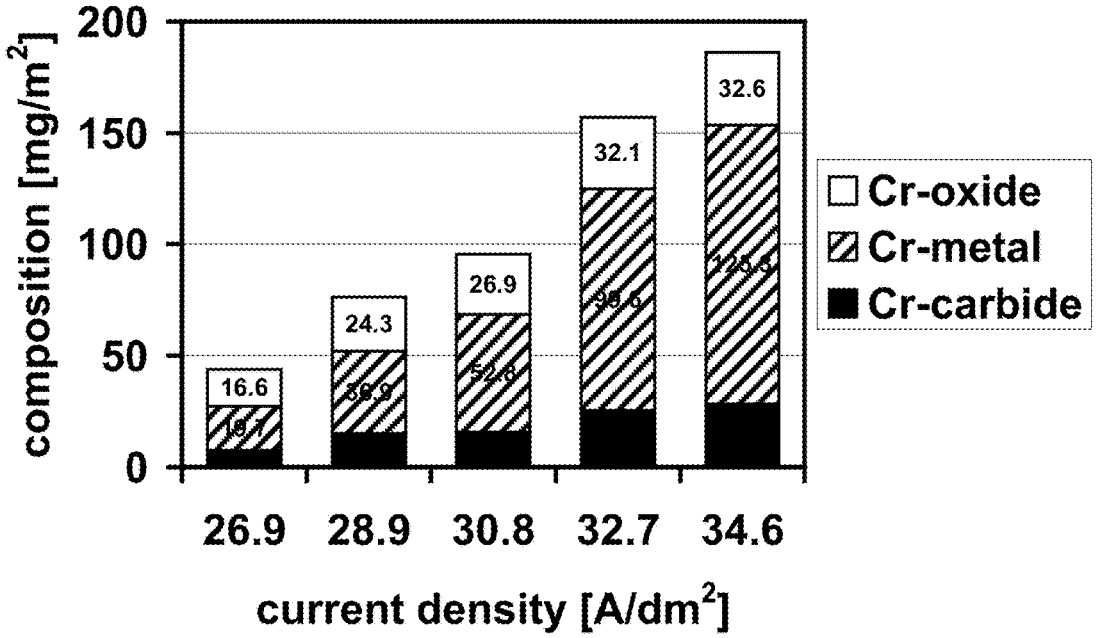
FIG. 5 shows a composition of a Cr-layer plotted as a function of current density, as determined from XPS spectra recorded.

In FIG. 5 the composition of the Cr-layer is plotted as a function of current density, as determined from XPS spectra recorded. The Cr-layer consists of a mixture of Cr-oxide, Cr-metal and Cr-carbide. The Cr-oxides are not present as a distinct layer on the outermost surface, but the oxides seem to be dispersed in the whole layer. The Cr-layer consists mainly of metallic Cr. Increasing the current density gives higher Cr-coating weights and a relative increase of the Cr-metal in the layer. Nearly all the extra electrical current is used to deposit Cr-metal. The increase in Cr-oxide and Cr-carbide is very small.

To get a semi quantitative number (ranking) of the porosity the wt. % of the substrate elements (i.e. Sn and Fe) was divided by the wt. % of the coating element (Cr). The concentrations were integrated over the first 3.5 nm for better statistics. This could safely be done because even the thinnest coating is thicker than 6 nm.

Figure 6:
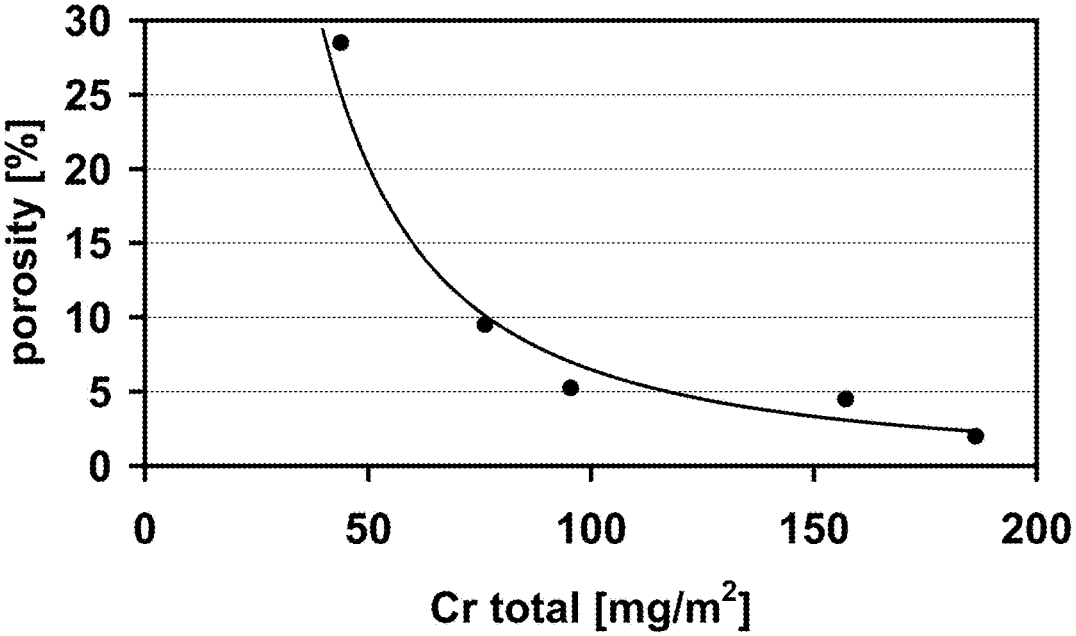
FIG. 6 shows the porosity of a Cr-layer plotted versus the Cr-coating weight.
Figure 7:
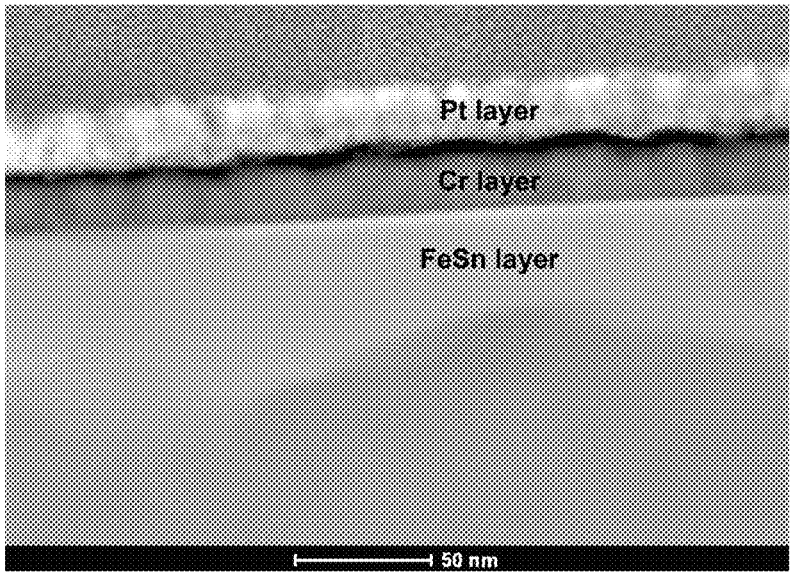
FIG. 7 shows a TEM image of a sample of Cr-CrOx layer deposited at a current density of 28.9 A/dm2.
Figure 8:
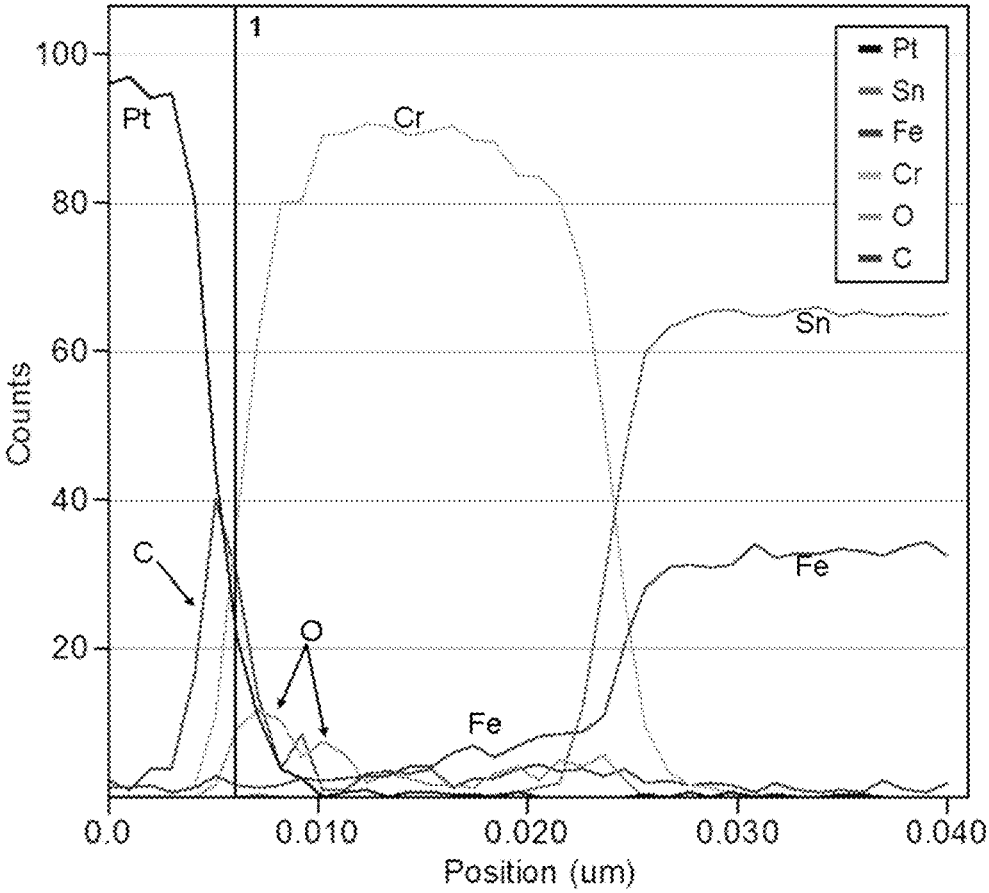
FIG. 8 shows an EDX line scan of the sample of the Cr-CrOx layer deposited at a current density of 28.9 A/dm2.

In FIG. 6 the porosity of the Cr-layer is plotted versus the Cr-coating weight. This figure shows that the porosity strongly decreases with increasing coating weight. A TEM image (FIG. 7, the Pt-layer was deposited later to protect the coating during preparation of the TEM-sample and the distance bar indicated a length of 50 nm) and an EDX line scan (FIG. 8) of the sample of the Cr—CrOx layer deposited at a current density of 28.9 A/dm$^2$ confirms that the Cr-layer is closed and mainly consists of Cr-metal.

Steel sheet samples with an FeSn coating produced as described hereinabove were provided with a Cr—CrOx coating from a trivalent chromium electrolyte with the composition as described above by first activating the samples in a 50 g/l sulphuric acid solution at room temperature for about 10 s followed by thorough rinsing with de-ionised water. The samples were then positioned between 2 graphite anodes in a plating cell filled with the trivalent chromium electrolyte. The distance between the sample and each anode was 50 mm. The solution was moderately agitated by a magnetic stirrer.

Several sets of samples were produced, of which the results of the set with an average Cr—CrOx coating weight of ca. 70 mg/m$^2$ and the set with an average Cr—CrOx coating weight of ca. 20 mg/m$^2$ are presented in Table 2.

TABLE 2

| plating conditions | | |
|---|---|---|
| current density [A/dm$^2$] | deposition time [s] | Cr (XRF) [mg/m$^2$] |
| 15.0 | 0.5 | 21 ± 5 |
| 15.0 | 1.0 | 68 ± 10 |

After the electro-deposition of the Cr—CrOx coating each sample was thoroughly rinsed with de-ionised water and dried by means of a set of squeegee rolls.

All samples were subsequently provided with a commercially available 20 micron thick PET film, through lamination (heat sealing). After lamination the samples were post-heated to temperatures above the melting point of PET and subsequently quenched in water at room temperature as per a usual processing regime in PET-lamination of metal substrates.

The same lamination procedure was followed for the reference materials, which consisted of FeSn coated steel sheets without a Cr—CrOx coating and sheets taken from a commercially produced coil of TFS (Tin Free Steel a.k.a. ECCS). This TFS is produced from a hexavalent chromium based plating bath.

The laminated sheets were used to manufacture DRD cans (draw-single redraw operation, draw ratio 1.6, no thinning/sizing, blank diameter 100 mm.). The cans were filled with a solution of 3.6% NaCl in aerated tap water. The cans were closed with a standard double seam and sterilised for 60 minutes at 121° C. The cans were then cooled to room temperature, opened, rinsed shortly and dried for one day. The bottom and the wall of the cans were evaluated for corrosion spots and/or delamination of the PET coating. This is a very tough test for this laminated system as the performance of the TFS (reference 2) shows. Even for a commercially marketed and very successful product there is still a small amount of discernable delamination. In normal circumstances of the use of the product this delamination does not occur, but the severe test is a quick and representative way of ranking different coating systems. This test shows that starting at a thickness of the Cr—CrOx conversion coating of ~20 mg Cr/m$^2$ already results in a significant improvement in comparison to the samples without a Cr—CrOx coating and that starting at a thickness of about 60 mg Cr/m$^2$ the performance is already identical to that of the current products.

The results were ranked according to the extent of delamination in the bottom part of the cans in Table 3.

TABLE 3

| delamination results | | | |
|---|---|---|---|
| FeSn without a conversion coating (reference 1) | FeSn with a Cr—CrOx conversion coating (~20 mg Cr/m$^2$) | FeSn with a Cr—CrOx conversion coating (~70 mg Cr/m$^2$) | TFS (reference 2) |
| -- | - | + | + |

-- delamination over more than 50% of the surface
- delamination between 20 and 50% of the surface
+ delamination between 1 and 5% of the surface The results show that applying a coating of Cr—CrOx has a very positive effect in terms of suppressing coating delamination. By applying a thicker Cr—CrOx coating a product performance level similar to that of the currently produced TFS is obtained.

The invention claimed is:

1. A coated substrate for packaging applications comprising a steel substrate selected from:

a recrystallisation annealed single reduced steel substrate or a double reduced steel substrate which was subjected to a first and second cold rolling treatment and recrystallisation annealing between the first and second cold rolling treatment, wherein one or both sides of the steel substrate is coated with an iron-tin alloy layer which contains at least 85 weight percent (wt. %) of FeSn (50 at. % iron and 50 at. % tin), and wherein the iron-tin alloy layer or layers are provided with a chromium metal—chromium oxide coating layer produced by a trivalent chromium electroplating process, and wherein the thickness of the chromium metal—chromium oxide coating layer corresponds to at least 20 mg Cr/m$^2$, and wherein the Cr-oxide is not present as a distinct layer on the outermost surface of the chromium metal—chromium oxide coating layer but wherein the Cr-oxide is dispersed in the layer, wherein the chromium metal—chromium oxide coating layer produced by the trivalent chromium electroplating process consists of a mixture of Cr-oxide, Cr-metal and Cr-carbides.

2. The coated substrate for packaging applications according to claim 1, wherein the iron-tin alloy layer contains at least 90 wt. % of FeSn.

3. The coated substrate for packaging applications according to claim 1, wherein the iron-tin alloy layer is provided with a tin layer prior to application of the chromium metal—chromium oxide coating layer, optionally wherein the tin layer was subsequently reflowed prior to application of the chromium metal—chromium oxide coating layer.

4. The coated substrate for packaging applications according to claim 1, wherein:

a. the initial tin coating weight, prior to annealing to form the iron-tin alloy layer is at most 1000 mg/m$^2$, and/or b. wherein total chromium content of the chromium metal—chromium oxide layer is between 20 and 140 mg/m$^2$.

5. The coated substrate for packaging applications according to claim 1, wherein the coated substrate is further provided with an organic coating, consisting of a thermoset organic coating, or a thermoplastic single layer polymer coating, or a thermoplastic multi-layer polymer coating.

6. The coated substrate for packaging applications according to claim 5, wherein the thermoplastic polymer coating is a polymer coating system comprising one or more layers comprising thermoplastic resin selected from the group consisting of polyesters, polyolefins, acrylic resins, polyamides, polyvinyl chloride, fluorocarbon resins, polycarbonates, styrene type resins, ABS resins, chlorinated polyethers, ionomers, urethane resins, functionalised polymers, copolymers thereof, and blends thereof.

7. The coated substrate for packaging applications according to claim 1, wherein the substrate is subjected to a stretching operation at any moment after diffusion annealing.

8. The coated substrate according to claim 7, wherein the stretching operation is achieved by:

a. passing the material through a temper mill; or by b. passing the material through a stretcher-leveller.

9. The coated substrate according to claim 7, wherein the stretching operation is achieved by passing the material through a temper mill and applying a thickness reduction 0.2%-3%.

10. The coated substrate for packaging applications according to claim 1, wherein the iron-tin alloy layer contains at least 95 wt. % of FeSn.

11. The coated substrate for packaging applications according to claim 1, wherein:

a. the initial tin coating weight, prior to annealing to form the iron-tin alloy layer is 100 to 600 mg/m$^2$ of substrate and/or b. wherein total chromium content of the chromium metal—chromium oxide layer is between 40 and 90 mg/m$^2$.

12. The coated substrate for packaging applications according to claim 1, wherein total chromium content of the chromium metal—chromium oxide layer is between 60 and 80 mg/m$^2$.

13. The coated substrate according to claim 1, wherein the initial tin coating weight, prior to annealing to form the iron-tin alloy layer is at least 100 and/or at most 600 mg/m$^2$ of substrate.

14. A process for producing the coated steel substrate for packaging applications of claim 1, the process comprising the steps of:

Providing a steel substrate selected from:

a recrystallisation annealed single reduced steel substrate, or a double reduced steel substrate which was subjected to a first and a second cold rolling treatment and recrystallisation annealing between the first and second cold rolling treatment;

Providing a first tin layer onto one or both sides of the steel substrate in a first electroplating step;

Diffusion annealing the steel substrate provided with said tin layer in a reducing gas atmosphere to an annealing temperature $T_a$ of at least 513° C. for a time $t_a$ sufficient to convert the first tin layer into an iron-tin alloy layer or layers which contains or contain at least 85 weight percent (wt. %) of FeSn (50 at. % iron and 50 at. % tin);

Cooling the steel substrate with the iron-tin alloy layer(s) in an inert, non-oxidising cooling medium, while keeping the steel substrate with the iron-tin alloy layer(s) in a reducing or inert gas atmosphere prior to cooling, to obtain a surface oxide;

Depositing a chromium metal—chromium oxide coating on the substrate with the iron-tin alloy layer(s) by a trivalent chromium electroplating process comprising electrolytically depositing on said steel substrate with the iron-tin alloy layer(s) said chromium metal—chromium oxide coating in one plating step from a plating solution mixture of a trivalent chromium compound, a chelating agent, an optional conductivity enhancing salt, an optional depolarizer, an optional surfactant and to which an acid or base can be added to adjust the pH, thereby preventing the use of hexavalent chromium chemistry, wherein the thickness of the chromium metal—chromium oxide coating layer corresponds to at least 20 mg Cr/m$^2$, and wherein the Cr-oxide is not present as a distinct layer on the outermost surface of the chromium metal—chromium oxide coating layer but wherein the Cr-oxide is dispersed in the layer, wherein the chromium metal—chromium oxide coating layer produced by the trivalent chromium electroplating process consists of a mixture of Cr-oxide, Cr-metal and Cr-carbides.

15. The process according to claim 14, wherein the cooling is achieved by means of water quenching, wherein the water used for quenching has a temperature between room temperature and 80° C., and wherein the quenching process is designed to create and maintain a homogeneous cooling rate over the strip width.

16. The process according to claim 15, wherein the water used for quenching has a temperature between room temperature and 60° C.

17. The process according to claim 14, wherein:

the annealing process comprises:

use of a heating unit able to generate a heating rate exceeding 300° C./s in a hydrogen containing atmosphere, and/or followed by a heat soak kept at the annealing temperature to homogenise the temperature distribution across the width of the strip, and/or the annealing process is directly followed by rapid cooling at a cooling rate of at least 100° C./s, and/or wherein the cooling is performed in an reducing gas atmosphere, and/or the cooling is performed by means of water quenching, by using submerged spraying nozzles, wherein the water used for quenching has a minimal dissolved oxygen content and/or has a temperature between room temperature and 80° C., while keeping the substrate with the iron-tin alloy layer(s) shielded from oxygen by maintaining an inert or reducing gas atmosphere prior to quenching.

18. The process according to claim 14, wherein the chelating agent comprises a formic acid anion, the conductivity enhancing salt contains an alkali metal cation and the depolarizer comprises a bromide containing salt.

19. The process according to claim 14, wherein the cationic species in the chelating agent, the conductivity enhancing salt and the depolarizer is potassium.

20. The process according to claim 14, wherein the iron-tin alloy layer is provided with a tin layer prior to application of the chromium metal—chromium oxide coating, optionally wherein the tin layer is subsequently reflowed prior to application of the chromium metal—chromium oxide coating.

21. The process according to claim 14, wherein the coated substrate is further provided on one or both sides with an organic coating, consisting of a thermosetting organic coating by a lacquering step, or a thermoplastic single layer polymer, or a thermoplastic multi-layer polymer by a film lamination step or a direct extrusion step.

22. The process according to claim 21, wherein the thermoplastic polymer coating is a polymer coating system comprising one or more layers comprising a member of the group consisting of thermoplastic resins, polyesters, polyolefins, acrylic resins, polyamides, polyvinyl chloride, fluorocarbon resins, polycarbonates, styrene type resins, ABS resins, chlorinated polyethers, ionomers, urethane resins, functionalised polymers, copolymers thereof, and blends thereof.

23. The process according to claim 14, wherein an anode is chosen that reduces or eliminates the oxidation of Cr(III)-ions to Cr(VI)-ions during the plating step.

24. The process for producing a coated steel substrate for packaging applications according to claim 14, wherein the tin coating weight provided by the first electroplating step is at most 1000 $mg/m^2$ and/or at least 100 $mg/m^2$ of substrate surface.

* * * * *